US006160974A

United States Patent [19]

Yoshikawa et al.

[11] Patent Number: 6,160,974

[45] Date of Patent: Dec. 12, 2000

[54] IMAGE FORMING APPARATUS CAPABLE OF SWITCHING A SHEET INTERVAL MODE DURING AN IMAGE FORMING CYCLE

[75] Inventors: Takahiro Yoshikawa, Kanagawa; Shinji Etoh, Tokyo, both of Japan

[73] Assignee: Ricoh Company, Ltd., Tokyo, Japan

[21] Appl. No.: 09/137,121

[22] Filed: Aug. 20, 1998

[30] Foreign Application Priority Data

Aug. 21, 1997 [JP] Japan ..... 9-224960

[51] Int. Cl.[7] ..... G03G 15/00; G03G 15/20

[52] U.S. Cl. ..... 399/68; 399/45

[58] Field of Search ..... 399/45, 67, 68, 399/82, 388, 389, 69

[56] References Cited

U.S. PATENT DOCUMENTS

| | | | |
|---|---|---|---|
| 4,634,262 | 1/1987 | Imaizumi et al. | 399/45 |
| 5,282,001 | 1/1994 | Watson | 399/46 |
| 5,402,211 | 3/1995 | Yoshikawa . | |
| 5,521,676 | 5/1996 | Furushima | 399/69 |
| 5,621,511 | 4/1997 | Nakayama | 399/44 |
| 5,708,927 | 1/1998 | Etoh . | |

FOREIGN PATENT DOCUMENTS

| | | |
|---|---|---|
| 0 660 198 | 6/1995 | European Pat. Off. . |
| 195 15 581 | 1/1996 | Germany . |
| 63-184777 | 7/1988 | Japan . |
| 1-84270 | 3/1989 | Japan . |
| 3-10264 | 1/1991 | Japan . |
| 4-319964 | 11/1992 | Japan . |
| 5-6043 | 1/1993 | Japan . |
| 5-80604 | 4/1993 | Japan . |
| 6-130752 | 5/1994 | Japan . |

*Primary Examiner*—Joan Pendegrass
*Attorney, Agent, or Firm*—Oblon, Spivak, McClelland, Maier & Neustadt, P.C.

[57] ABSTRACT

An image forming apparatus including a fixing unit made up of a heat roller and a press roller and a plurality of sheet feeding devices is disclosed. The apparatus selects an interval between consecutive sheets matching with a sheet transport environment and the kind of sheets without waiting for the end of a sequence of image forming cycles. This allows toner images to be adequately fixed on sheets without regard to the kind of sheets, e.g., ordinary sheets or thick sheets.

3 Claims, 7 Drawing Sheets

IMAGE FORMING APPARATUS CAPABLE OF SWITCHING A SHEET INTERVAL MODE DURING AN IMAGE FORMING CYCLE

BACKGROUND OF THE INVENTION

The present invention relates to an electrophotographic image forming apparatus and, more particularly, to an image forming apparatus of the type including a fixing unit made up of a heat roller and a press roller and a plurality of sheet feeding devices.

A copier, facsimile apparatus, printer or similar image forming apparatus of the type described is conventional. While sheets are sequentially fed from any one of a plurality of sheet feeding devices and conveyed via a fixing unit, the sheets absorb the heat of a heat roller included in the fixing unit and thereby lower the temperature of the roller. The degree of the temperature fall of the heat roller depends on, e.g., the sheet transport environment including the preset temperature and input voltage of the heat roller, the thickness, quality and other factors of sheets, and the interval between consecutive sheets. Specifically, assume that thick sheets are sequentially transported in a usual sheet interval mode assigned to usual sheets and setting up a sheet interval insuring desirable fixation even when the temperature of the heat roller falls. Then, the thick sheets noticeably absorbs the heat of the heat roller and thereby lowers the temperature of the heat roller to a critical degree.

In light of the above, it has been customary to increase the sheet interval for thick sheets in order to maintain fixation adequate. However, none of conventional implementations is capable of switching the sheet interval while a sequence of image forming cycles are under way. That is, the sheet interval can be switched only after the end of a sequence of image forming cycles. Assume that usual sheets are transported when the sheet interval greater than one assigned to usual papers is set. Then, the number of sheets that can be transported and therefore the image forming efficiency is reduced, and in addition power is wastefully consumed. Thus, should a sheet interval suitable for one of usual sheets and thick sheets be set up, the above trouble would occur during transport of the other sheets.

Technologies relating to the present invention are also disclosed in, e.g., Japanese Patent Laid-Open Publication Nos. 63-184777, 4-319964, and 5-6043.

SUMMARY OF THE INVENTION

It is therefore an object of the present invention to provide an image forming apparatus capable of switching a sheet interval in accordance with a sheet transport environment and the kind of sheets without waiting to the end of a sequence of image forming cycles, and thereby insuring desirable fixation without regard to the kind of sheets.

An image forming apparatus of the present invention includes a fixing unit including a heat roller, and a plurality of sheet feeding devices each being capable of selectively setting up or cancelling any one of a plurality of sheet interval modes each setting up a particular interval between consecutive sheets.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
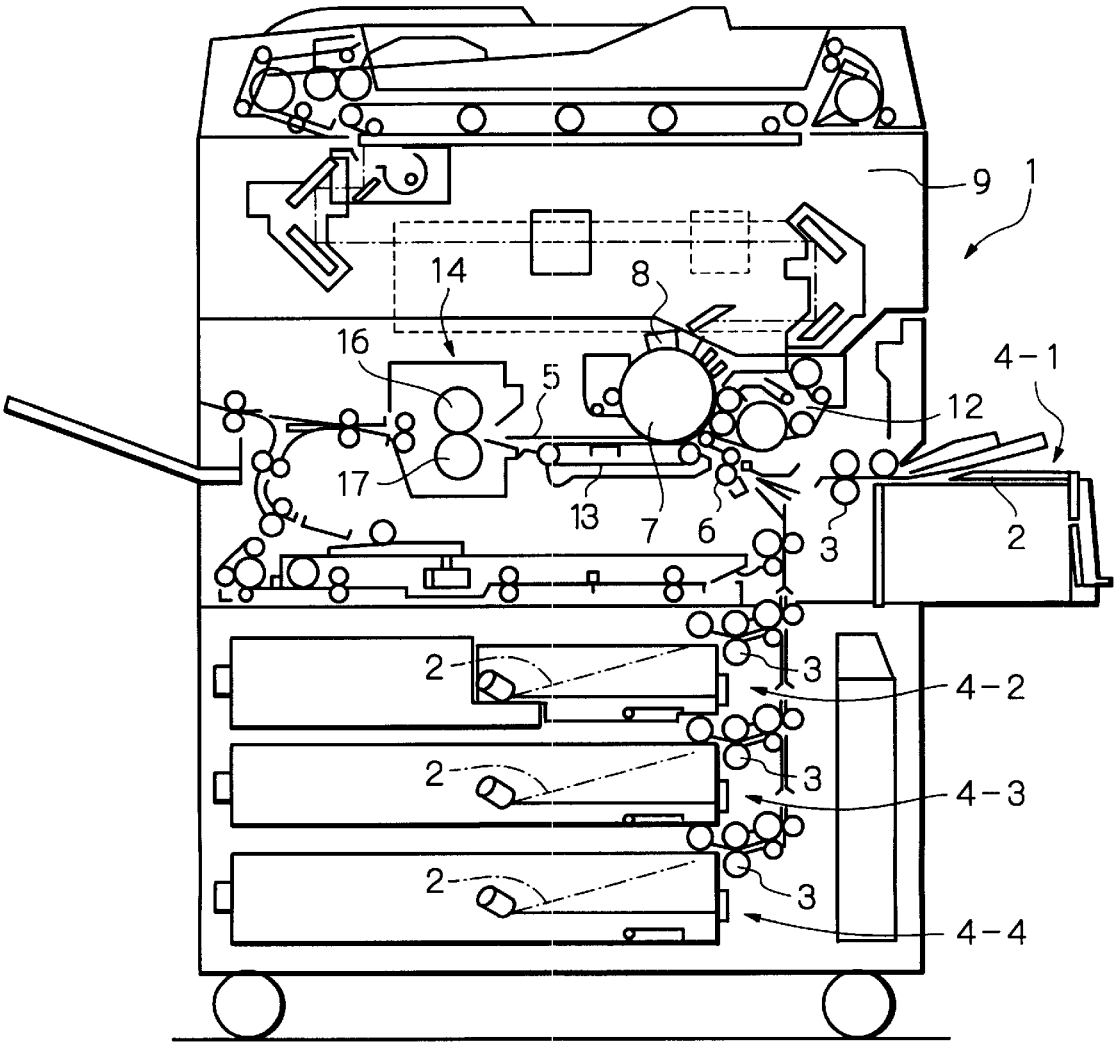
FIG. 1 shows an image forming apparatus to which the present invention is applied.

Referring to FIG. 1 of the drawings, an image forming apparatus to which the present invention is applied is shown and implemented as an electrophotographic copier by way of example. As shown, the copier includes a body 1 on which a plurality of sheet feeding devices 4-1, 4-2, 4-3 and 4-4 are mounted. The sheet feeding devices 4-1 through 4-4 each has a respective sheet cassette 2 and a feed roller 3. A sheet 5 is fed from any one of the sheet feeding devices 4-1 through 4-4 toward a registration roller 6. The registration roller 6 drives the sheet 5 toward a photoconductive element 7 being rotated at a preselected timing. The photoconductive element 7 is implemented as a drum by way of example. While the drum 7 is in rotation, its surface is uniformly charged by a charger 8. A scanner 9 including a lamp for illuminating a document. The resulting reflection from the document is transformed to a corresponding electric image signal. The image signal is subjected to conventional image processing, and the resulting image data are fed to laser optics. The laser optics scans the charged surface of the drum 7 with a laser beam in order to form a latent image on the drum 7.

Figure 2:
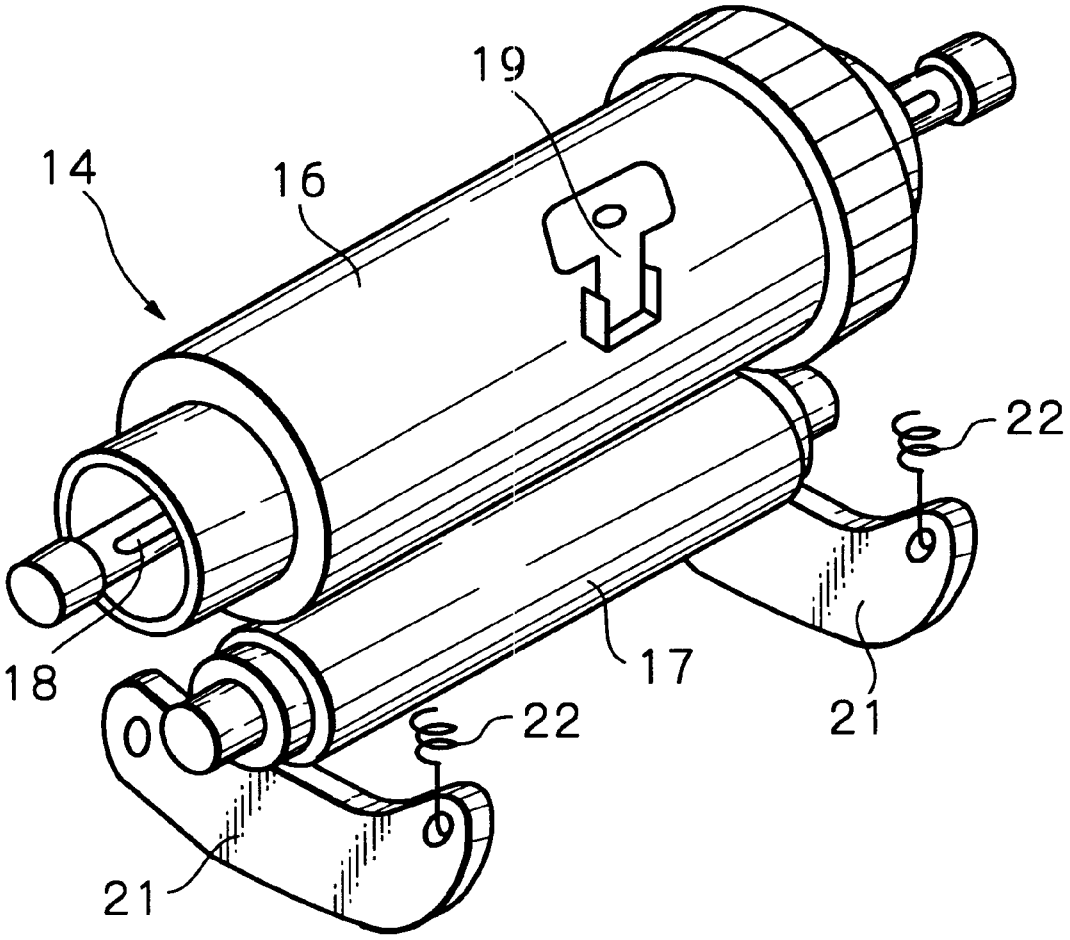
FIG. 2 is an external perspective view showing a fixing unit included in the apparatus of FIG. 1.

A developing unit 12 develops the latent image to produce a corresponding toner image. The toner image is transferred from the drum 7 to the sheet 5. The sheet 5 with the toner image is conveyed by a belt 13 to a fixing unit 14 made up of a heat roller 16 and a press roller 17. As shown in FIG. 2, the heat roller 16 has a lamp or heating member 18 thereinside. A temperature sensor 19 is positioned outside of the heat roller 16 for sensing the temperature of the surface of the roller 16. A current to be fed to the lamp 18 is controlled on the basis of the temperature of the heat roller 16 sensed by the temperature sensor 19. The press roller 17 has its shaft supported by a pair of levers 21 which are, in turn, supported at one end by a pivot shaft included in the copier body 1. A spring 22 is anchored at one end to the other end of each lever 21 and anchored at the other end to the copier body 1. In this configuration, the press roller 17 is constantly pressed against the heat roller 16. The sheet 5 with the toner image has the toner image fixed by the heat roller 16 and press roller 17.

Figure 3:
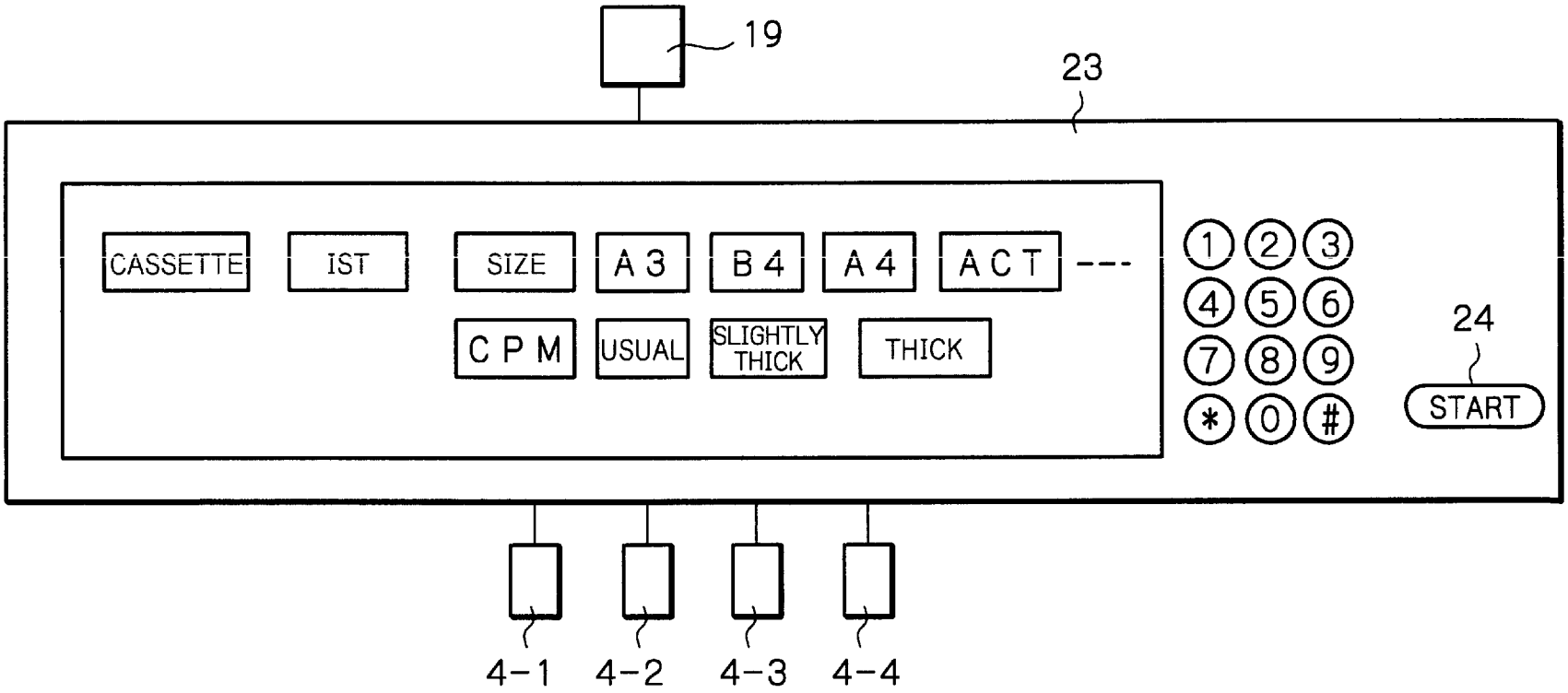
FIG. 3 is a plan view of a control section also included in the apparatus of FIG. 1.

FIG. 3 shows a control section 23 included in the copier. As shown, various buttons are arranged on the control section 23 for allowing the operator to input various kinds of information including information indicative of the usual sheet transport environment, information indicative of the kind of sheets, and information indicative of the temperature of the heat roller 16, and controlling the operation of desired one of the sheet feeding devices 4-1 through 4-4 in accordance with such information. By the resulting command output from the control section 23, the feed roller 3 of the desired sheet feeding device has its rotation speed, i.e., the interval between consecutive sheets or sheet interval controlled, as will be described specifically later.

Figure 4:
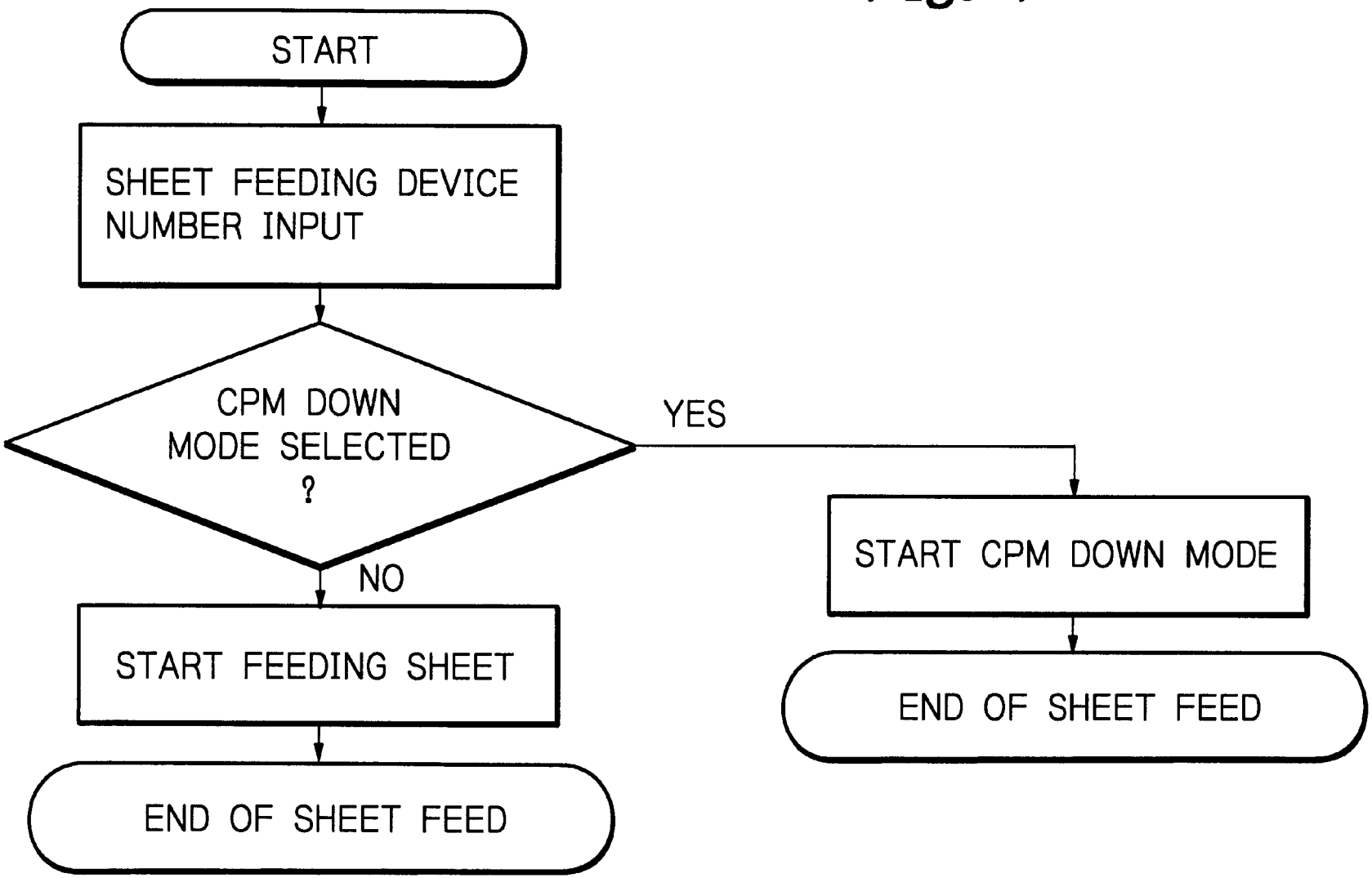
FIG. 4 is a flowchart representative of a first embodiment of the present invention.
Figure 5:
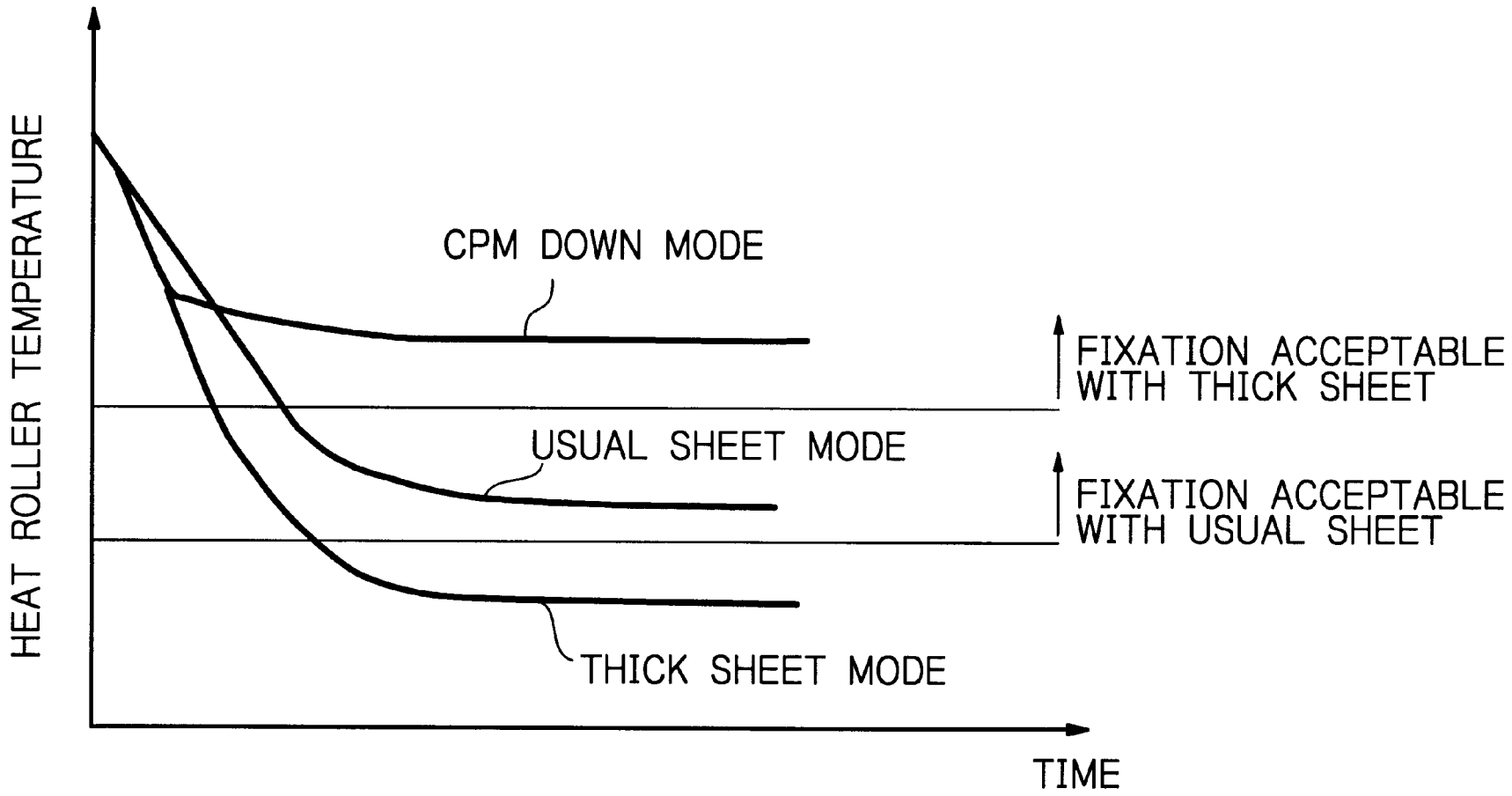
FIG. 5 shows a relation between the temperature of a heat roller and the time.

Reference will be made to FIGS. 4 and 5 for describing the operation of a first embodiment of the present invention and relating to the fixing unit 14. As shown, in the illustrative embodiment, a great sheet interval mode (CPM (Copies Per Minute) down mode hereinafter) setting up a greater interval than a usual sheet interval mode is available. The operator selects the CPM down mode for desired one of the sheet feeding devices 4-1 through 4-4 on the buttons of the control section 23. Then, the operator presses a start key 24 of the control section 23. In response, a fixing operation begins. In this condition, one of the sheet feeding devices 4-1 through 4-4 held in the CPM down mode feeds a reduced number of sheets for a unit time. As a result, a minimum of heat of the heat roller 16 is absorbed by such sheets, reducing the temperature fall rate of the heat roller 16. This allows even toner images carried on thick papers to be adequately fixed thereon. As for the other sheet feeding devices held in the usual interval mode, sheets are fed at a usual interval, i.e., the number of sheets fed for a unit time is not reduced.

An alternative embodiment of the present invention will be described hereinafter. The alternative embodiment is identical with the above embodiment as to the major part of the construction. The difference is that the alternative embodiment inputs temperature information relating to the heat roller 16 and output from the temperature sensor 19 to the control section 23. The CPM down mode is assigned to any one of the sheet feeding devices 4-1 through 4-4 in accordance with the temperature information.

Figure 6:
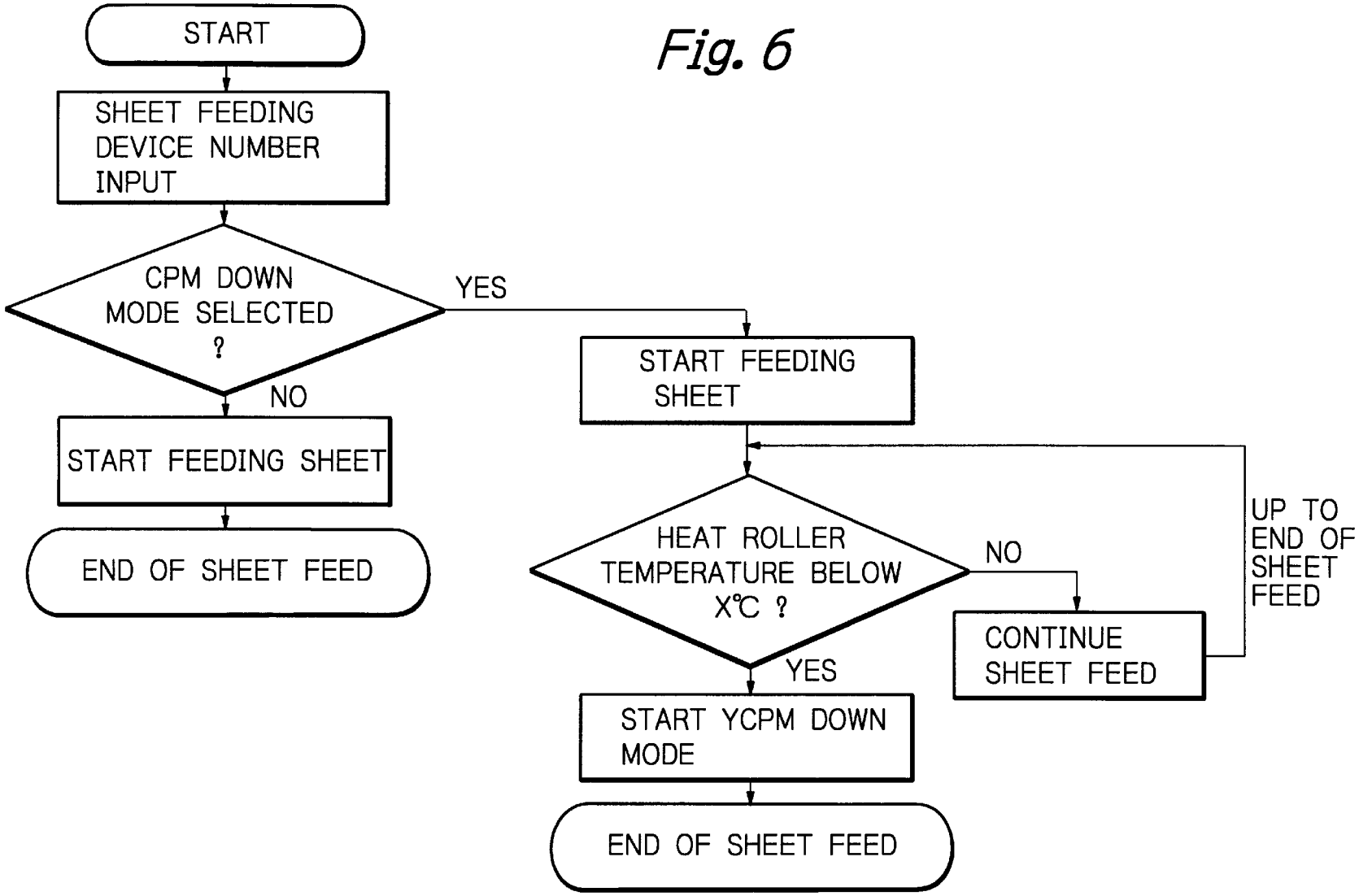
FIG. 6 is a flowchart representative of an alternative embodiment of the present invention.

Specifically, as shown in FIG. 6, one of the sheet feeding devices 4-1 through 4-4 to which the CPM down mode is assigned is caused to continuously feed its sheets so long as the temperature of the heat roller 16 remains above a preselected temperature x. When the temperature of the heat roller 16 falls to the temperature x, then the control section 23 starts operating the above one sheet feeding device in the CPM down mode. As a result, the illustrative embodiment maintains the usual interval mode, i.e., high productivity over a long period of time (number of sheets or time) up to the time when the CPM down mode starts. In addition, the CPM mode can start only if the temperature x is sensed during the transport of consecutive sheets through the heat roller 16.

Another alternative embodiment of the present invention will be described hereinafter which is identical with the embodiment of FIG. 6 except for the following. In this embodiment, when each sheet feeding device has two or more different sheet interval modes, i.e., when two or more heat roller temperatures are available for respectively triggering the sheet interval modes, the illustrative embodiment allows any one of the sheet interval modes and any one of the heat roller temperatures to be selected.

Figure 7:
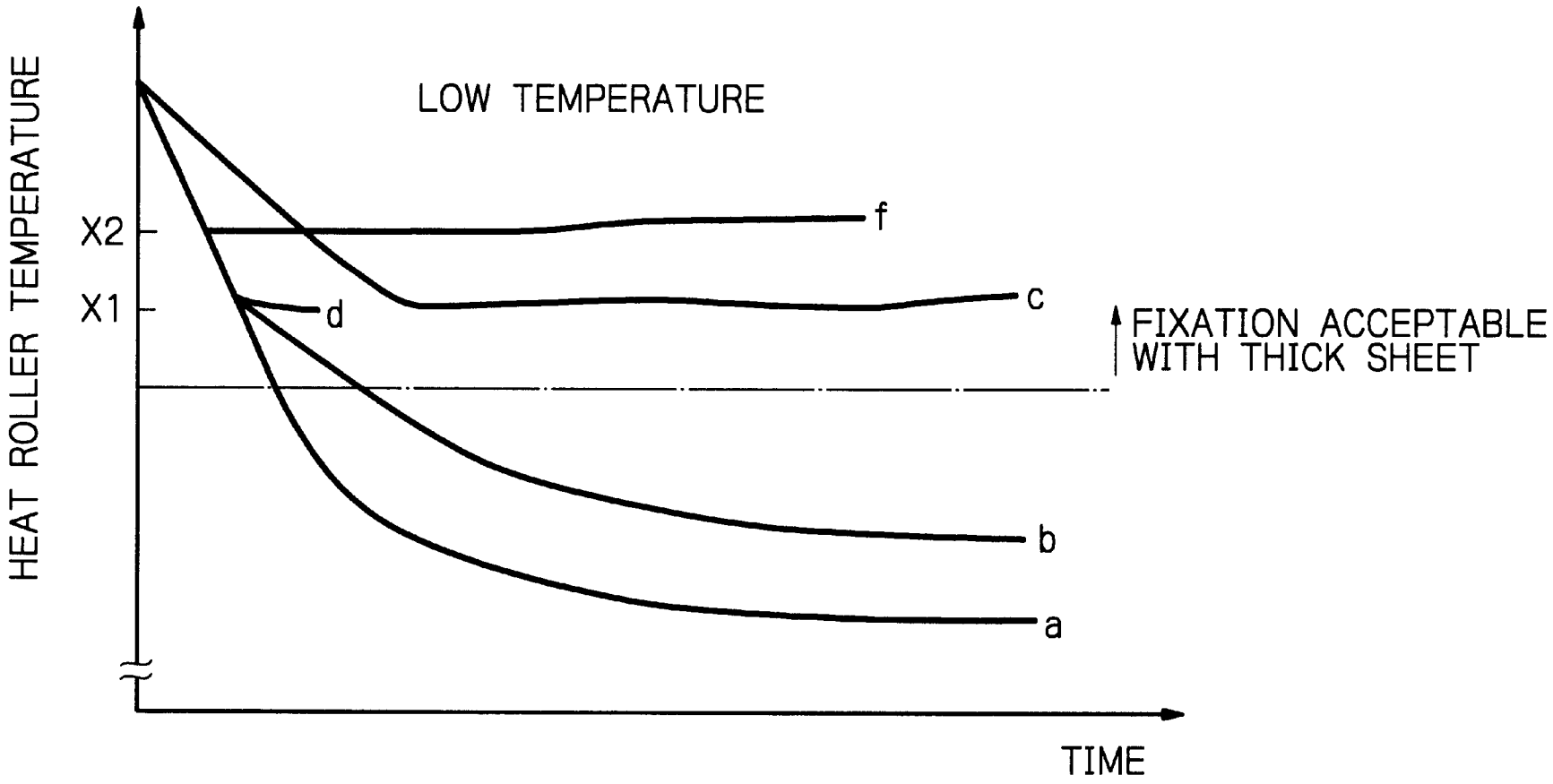
FIG. 7 shows a relation between the temperature of a heat roller and the time relating to another alternative embodiment of the present invention.

Specifically, as shown in FIG. 7, assume that sheets begin to be fed when the temperature is low and when the room environment is not satisfactory, e.g., when the copier is operated for the first time in the morning. Then, the heat roller temperature falls in the usual interval mode, as indicated by a curve a. When thick papers are transported at the usual ambient temperature in the CPM down mode, the heat roller temperature falls, but insures adequate fixation, as indicated by a curve c. However, the heat roller temperature falls to b even when the sheet interval assigned to the CPM down mode is set up, preventing adequate fixation from being maintained. In the illustrative embodiment, in the above condition, a heat roller temperature x1 is selected so as to maintain thick sheets transported in the CPM down mode at a temperature d. This successfully insures adequate fixation. When the thickness of thick papers further increases, the heat roller temperature is further raised to x2 in order to enhance desirable fixation. Any one of the sheet interval modes may be assigned to any one of the sheet feeding devices 4-1 through 4-4 by the operator on the control section 23, FIG. 3.

In summary, it will be seen that the present invention provides an image forming apparatus capable of switching a sheet interval in accordance with a sheet transport environment and the kind of sheets without waiting the end of an image forming operation, and thereby insuring desirable fixation without regard to the kind of sheets. In addition, simply by sensing the temperature of a heat roller while sheet transport is under way, it is possible to replace a usual sheet interval mode with a great sheet interval mode with ease.

Various modifications will become possible for those skilled in the art after receiving the teachings of the present disclosure without departing from the scope thereof.

What is claimed is:

1. An image forming apparatus, comprising:

a fixing unit including a heat roller configured to fix images on sheets;

a temperature sensor;

a plurality of sheet feeding devices; and a controller configured to control any one of said plurality of sheet feeding devices to decrease a corresponding copying rate in response to a temperature of the heat roller sensed by the temperature sensor in order to fix images on the sheets, and to control any of said plurality of sheet feeding devices to further decrease the corresponding copying rate in response to subsequently sensed temperatures of the heat roller in order to fix images on the sheets.

2. The image fixing apparatus according to claim 1, wherein said controller is configured to receive temperature information relating to the heat roller operating environment from an operator, and to control any one of said plurality of sheet feeding devices to decrease the corresponding copying rate in response to the sensed temperature of the heat roller and in accordance with the temperature information.

3. The image fixing apparatus according to claim 2, wherein said temperature information includes two or more heat roller temperatures which correspond to two or more predetermined copying rates, respectively, and said controller is configured to control any one of said plurality of sheet feeding devices to decrease the corresponding copying rate to the predetermined copying rate of said two or more predetermined copying interval which corresponds to a sensed temperature of the heat roller.

* * * * *